US005668520A

United States Patent [19]

Kinman

[11] Patent Number: 5,668,520

[45] Date of Patent: Sep. 16, 1997

[54] TRANSDUCER FOR A STRINGED MUSICAL INSTRUMENT

[76] Inventor: Christopher Ian Kinman, Unit 3, 28 Baldock Street, Moorooka Queensland, 4105, Australia

[21] Appl. No.: 616,569

[22] Filed: Mar. 15, 1996

[51] Int. Cl.[6] ..... H01F 27/36; G10H 3/14

[52] U.S. Cl. ..... 336/84 R; 84/728; 360/124

[58] Field of Search ..... 336/84 R, 110, 336/220, 221; 360/124; 84/725, 726, 728

[56] References Cited

U.S. PATENT DOCUMENTS

| | | | |
|---|---|---|---|
| 3,963,975 | 6/1976 | Gauper, Jr. et al. | 336/84 |
| 3,969,771 | 7/1976 | Suzuki et al. | 360/124 |
| 4,442,749 | 4/1984 | DiMarzio et al. | 84/728 |
| 4,524,667 | 6/1985 | Duncan | 84/728 |
| 5,168,117 | 12/1992 | Anderson | 84/728 |
| 5,464,948 | 11/1995 | Lace | 84/726 |

*Primary Examiner*—Stuart N. Hecker

*Attorney, Agent, or Firm*—Fishman, Dionne, Cantor & Colburn

[57] ABSTRACT

A transducer for a stringed instrument comprises a first uppermost coil and a second lowermost coil with the axes of the coils coincident. Permanent magnet pole pieces are arranged in the first coil and metallic non-magnetized pole pieces are arranged in the second coil. Oppositely directed U-shaped shields each having a web and outwardly directed opposed flanges are arranged back to back and receive the coils to shield the coils from each other both magnetically and inductively.

18 Claims, 7 Drawing Sheets

TRANSDUCER FOR A STRINGED MUSICAL INSTRUMENT

BACKGROUND OF THE INVENTION

THIS INVENTION relates to transducers or pickups for stringed musical instruments whose output is intended to be amplified. In particular, the invention provides an improved noise cancellation pickup.

The invention will be described by way of example with reference to the musical instrument to which the pickups are fitted as being electric guitars. It should be appreciated that this is by way of example only and that instruments other than guitars may also be fitted with pickups according to the invention.

Electric guitars typically have at least four strings which when vibrated produce an output for amplification. The vibration of the strings is converted to electrical signals by pickups. The frequency of the electrical signals produced by the pickups corresponds to the frequency of vibration of the strings.

Pickups typically consist of a single bar magnet within a coil or a plurality of permanent magnets with a coil. The strings of the guitar are made of a magnetically permeable material typically a ferromagnetic material and the magnetic lines of flux developed by the permanent magnets are intercepted by the vibrating strings. This causes variations in the field pattern and a varying current is caused to flow in the coils. The frequency of the current corresponds to the frequency of vibration of the strings.

The coils, as well as being influenced by vibration of the strings also are subjected to noise. Noise is produced by lighting, electric motors and appliances and other sources. This noise, or hum adversely affects the quality of the sound reproduced by the pickups. The fundamental frequency of the electrical supply voltage, typically 50 Hz or 60 Hz, is converted into an audible hum in the amplifying equipment.

Many attempts have been made at ways of reducing or eliminating this noise but these attempts have introduced other undesirable effects.

Leo Fender in the 1940s was responsible for developing a single coil pickup. His design was particularly noise prone and equated basically to a long antenna for extraneous noise such as 50 Hz or 60 Hz hum and buzz caused by electric motors, lighting and other electrical appliances.

U.S. Pat. No. 4,442,749 issued to DiMarzio discloses one such earlier attempt at reducing noise. DiMarzio disclosed an electrical pickup device for stringed instruments. The device had a pair of superimposed coaxial bobbins each axially wound with a coil having its axis perpendicular to the strings of the instrument. An integral shield of magnetic material was present and had a base disposed between the two bobbins perpendicular to the coil axis and two side walls extend upwardly and perpendicularly from the base to at least immediately below the top face of the upper bobbin. A plurality of rod-like permanent magnets extended through the upper and lower coils. Thus, a plurality of magnets common to both coils were arranged within the coils.

The shield extended around three sides of the pickup coil. The shield was not particularly effective and allowed the magnetic field in the pickup coil to influence the lower noise reducing coil to affect the inductance of the lower coil and the electrical signals induced into that coil. The tonal structure of the pickup as a whole was adversely affected when the inductance was reduced below an acceptable level and one way to remedy this was to overwind the coils.

DiMarzio in a first device employed magnetic pole pieces common to both coils and this prohibits attaining a suitable overall inductance value because of inductance cancellation between the two coils.

DiMarzio in a second embodiment discloses a pickup having an upper coil with a plurality of magnetic pole pieces arranged within it. A lower noise cancelling coil is also shown. A channel shaped member receives the upper coil. Although the channel member extends around the upper coil, the coils are not effectively magnetically and inductively decoupled from one another. By doing this noise cancellation is achieved at the expense of tone quality.

An attempt at noise cancellation in pickup design was also made by Seymour Duncan. His design used full length Alnico V magnets which extended vertically through two coils. Like the DiMarzio design, the Duncan design also caused inductance and signal cancellation. Duncan did not employ any kind of magnetic barrier to separate the upper and lower coils.

A company known as EMG produced a pickup design known as Strat Vintage or SV. EMG employed full length magnets which extended through both an upper and a lower coil. Each coil was separately buffered into a two input differential operational amplifier but the inductance was less than 2.5 H since the inductance of the top half coil was 0.8 H. The lower coil was of similar inductance.

SUMMARY OF THE INVENTION

It is an object of the present invention to provide an improved transducer or pickup for stringed musical instruments which provides for effective noise or hum cancellation while not sacrificing tone quality.

According to one aspect of the invention, there is provided a transducer having a first coil, a second coil arranged with its axis coincident with the axis of the first coil and in use spaced below the first coil, a metallic shield made of magnetically permeable material arranged between the coils, the shield having one or more outwardly directed walls with the wall or walls of the shield extending over sides of the coils, at least one permanent magnet pole piece associated with the first coil and at least one metallic magnetically permeable pole piece associated with the second coil, whereby the coils are inductively and magnetically decoupled from one another by the shield.

The upper and lower coils may be wound with the same or different gauge of wire. Preferably, each of the coils has between 1000 to 7000. More preferably, each coil has about 5000 turns. The coils need not have the same number of turns.

It is preferred that the coils be impedance matched or balanced and tuned so that the inductance of each coil is the same. This may be achieved by adopting a suitable wire gauge and number of turns for the coils and by the desired choice of the metallic pole pieces for the lower coil as discussed below.

As mentioned, there may be a unitary metallic magnetically permeable pole piece associated within the lower coil. In an alterative construction, a plurality of metallic magnetically permeable pole pieces are present.

The (single) or each (plural) metallic pole piece for the lower coil are preferably made of mild steel although other metals are not excluded and are in contact with the associated shield. Where there are a plurality of pole pieces, two outer most pole pieces may be full height core pieces extending through the lower coil and intermediate pole pieces may be approximately one third of this height and located adjacent an upper part of the coil and extending part way into the coil.

The lower coil is contained within the shield. The shield is made of a metallic magnetically permeable material. Typically, the shield is made from mild steel and may have a thickness of about 0.4 mm. Respective non-metallic plates may be arranged on both sides of the lower coil. The shield may be present as a tray having a base and a continuous upstanding wall. Alternatively, the shield may be U shaped having a base and two opposed upstanding side walls. The shield may be H shaped in transverse cross section and the lower coil may be received between the cross member of that section and the downwardly directed side flanges.

The non-metallic plates may have a plurality of apertures for receiving the pole pieces located within the lower coil.

The upper coil is contained within the shield. The shield may be constructed in a similar fashion to the shield which receives the lower coil. As with the lower coil, respective non-metallic plates may be arranged on both sides of the upper coil. Of course, if the shield is H shaped in transverse cross section the upper coil is received between the cross member of that section and the upwardly directed side flanges.

The H shaped shield may be made as a unitary component or from several pieces.

As mentioned there may be a unitary permanent magnetic pole piece associated with the upper coil. Preferably, a plurality of permanent magnet pole pieces are associated with the upper coil. The (single) or each (plural) magnetic pole piece is in contact with the associated shield.

Permanent magnet pole pieces of a number commensurate with the number of strings of the instrument to which the transducer is fitted are preferably arranged within the upper coil. Preferably, the non-metallic plates associated with the upper coil have apertures for receiving the magnetised pole pieces. Preferably, the pole pieces project through the apertures in the plate nearest to the instrument strings.

The magnetic pole pieces may be made from ALNICO II or ALNICO V or any other suitable magnetic material.

The two coils, because of the arrangement described, are both magnetically and inductively isolated from one another. The upper coil is subjected to the influence of the movement of the strings and noise while the lower coil is subjected only to noise. Because of the close proximity of the coils to one another, they respond equally to the effects of noise. By connecting the coils together either in parallel or series but out of phase, noise can be effectively cancelled from the signal.

BRIEF DESCRIPTION OF THE DRAWINGS

A particular preferred embodiment of the invention will now be described by way of example with reference to the drawings in which.

DETAILED DESCRIPTION OF THE PREFERRED EMBODIMENTS

Figure 1:
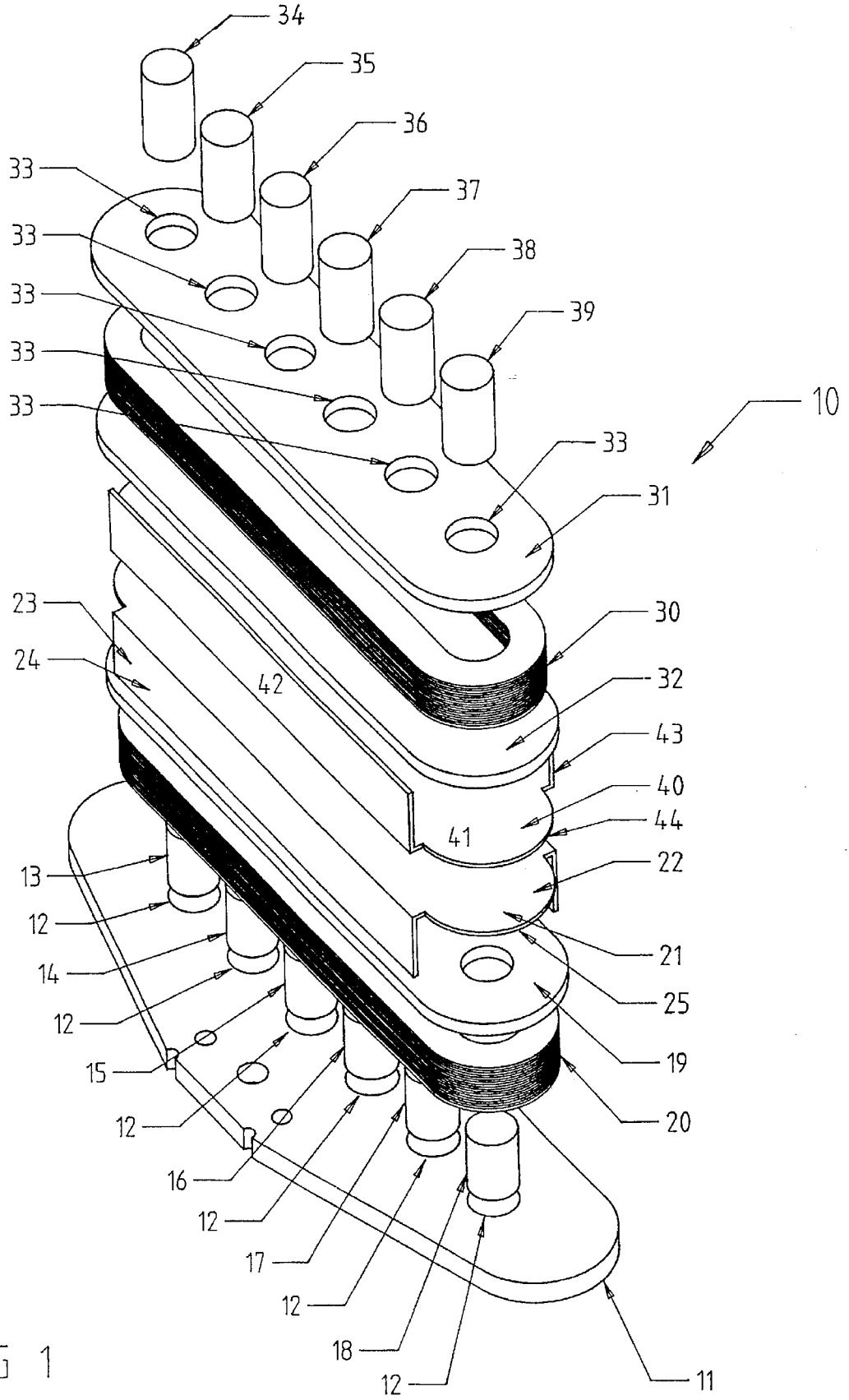
FIG. 1 is an exploded perspective view of a transducer according to the invention.

FIG. 1 shows a transducer 10 having a non-metallic nonconductive base plate 11. Plate 11 has a series of holes 12 for receiving mild steel non-magnetised pole pieces 13, 14, 15, 16, 17, 18. Although all of these pole pieces are shown being the same length only the two outermost pieces 13 and 18 need be full height. The innermost pole pieces 14, 15, 16 and 17 may be one third of the height shown and retained by top plate 19. Plate 19 is constructed of the same material as plate 11. A lower coil 20 extends around pieces 13 to 18 and is located between plates 11 and 19. Shield 21 has a web 22 and two opposed downwardly directed flanges 23, 24. These flanges extend over sides of the coil 20. Web 22 has rounded ends 25 (only one of which is visible in this view). Flanges 23 and 24 terminate half way across the outermost pole pieces 13 and 18 although they may extend beyond them if desired.

An upper coil 30 is arranged between plates 31 and 32. These plates are constructed of the same material as plates 11 and 19. Plates 31 and 32 have holes 33 for receiving magnetic pole pieces 34, 35, 36, 37, 38, 39. A shield 40 having a web 41 and opposed flanges 42, 43 together with shield 21 magnetically separate coil 30 from coil 20. Web 41 overlies and abuts against web 22. Flanges 42, 43 extend upwardly and over sides of the coil 30. Web 41 has rounded ends 44 (only one of which is visible in this view). Flanges 42, 43 terminate midway over the outermost pole pieces 34 and 39.

Figure 2:
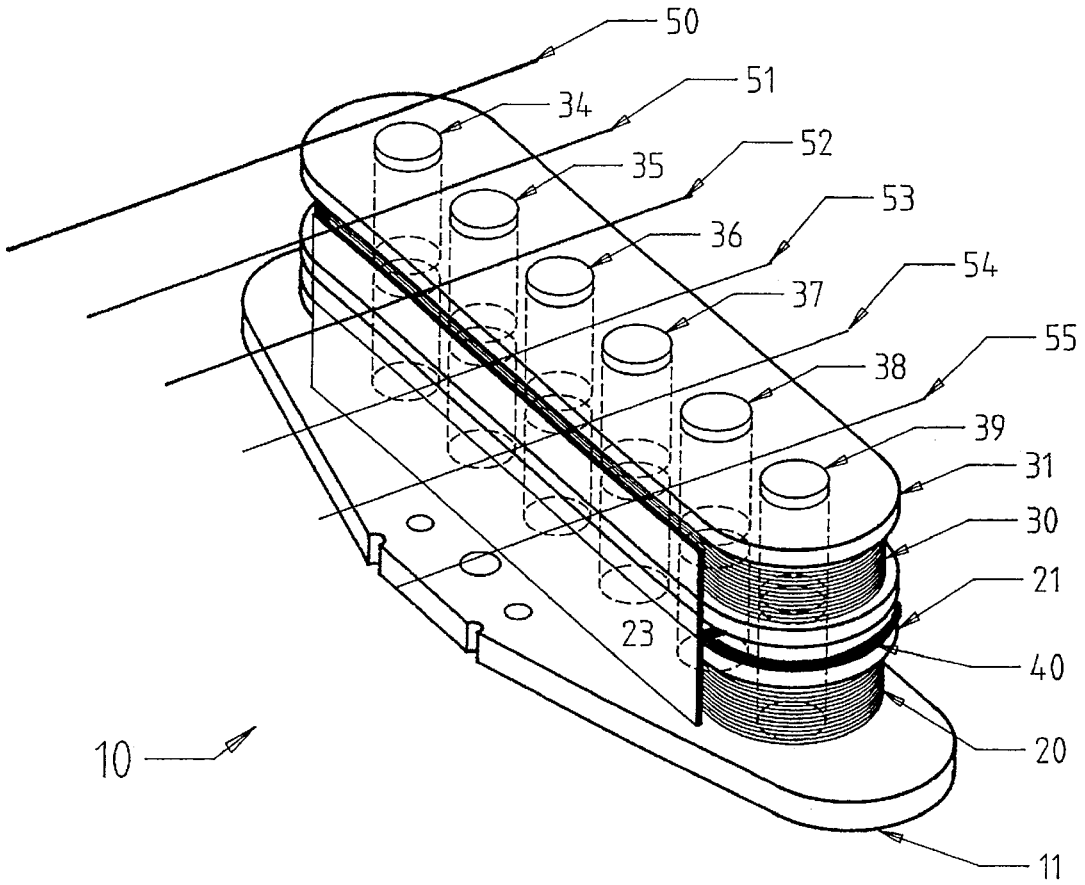
FIG. 2 is an assembled perspective view of the transducer of FIG. 1.

FIG. 2 shows an assembled perspective view of the transducer 10. The orientation assumed by strings 50, 51, 52, 53, 54, 55 relative to transducer 10 is shown. Coil 30 is shown closest to the strings while coil 20 is lowermost with the coils being coaxial with one another. The U shaped shields 21 and 40 effectively ensure that coil 20 is not subjected to the magnetic field of pole pieces 34, 35, 36, 37, 38, 39 and the magnetic field is directed towards the strings of the instrument to which the transducer 10 is fitted.

Figure 3:
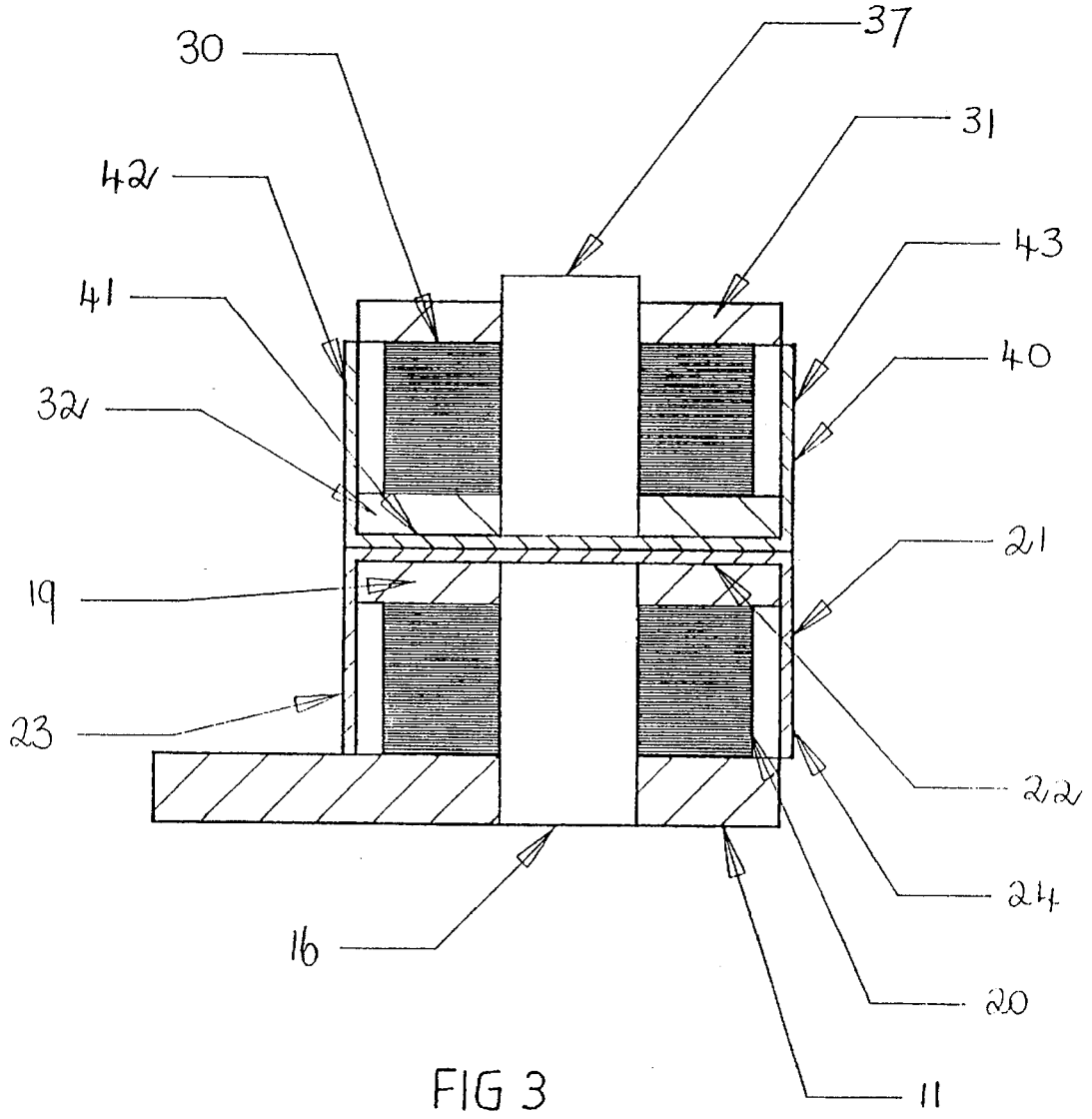
FIG. 3 is a transverse sectional view of the transducer of FIG. 2.

FIG. 3 is a transverse sectional view of the transducer 10 shown in FIG. 2. The shields 21 and 40 are shown surrounding the respective coils on three sides. The flanges 23 and 24 of shield 21 extend downwardly over sides of lower coil 20 while flanges 42 and 43 of shield 40 extend upwardly over the sides of coil 30.

Magnetic pole piece 37 is held between plates 31 and 32 as indeed are the other pole pieces not visible in this view. Webs 22 and 41 separate the coils from one another. Base plate 11 and plate 19 receive metallic pole piece 16 between them as indeed are the other pole pieces not visible in this view. Magnetic pole piece 37 extends a short distance beyond plate 31. So do the other magnetic pole pieces.

Figure 4:
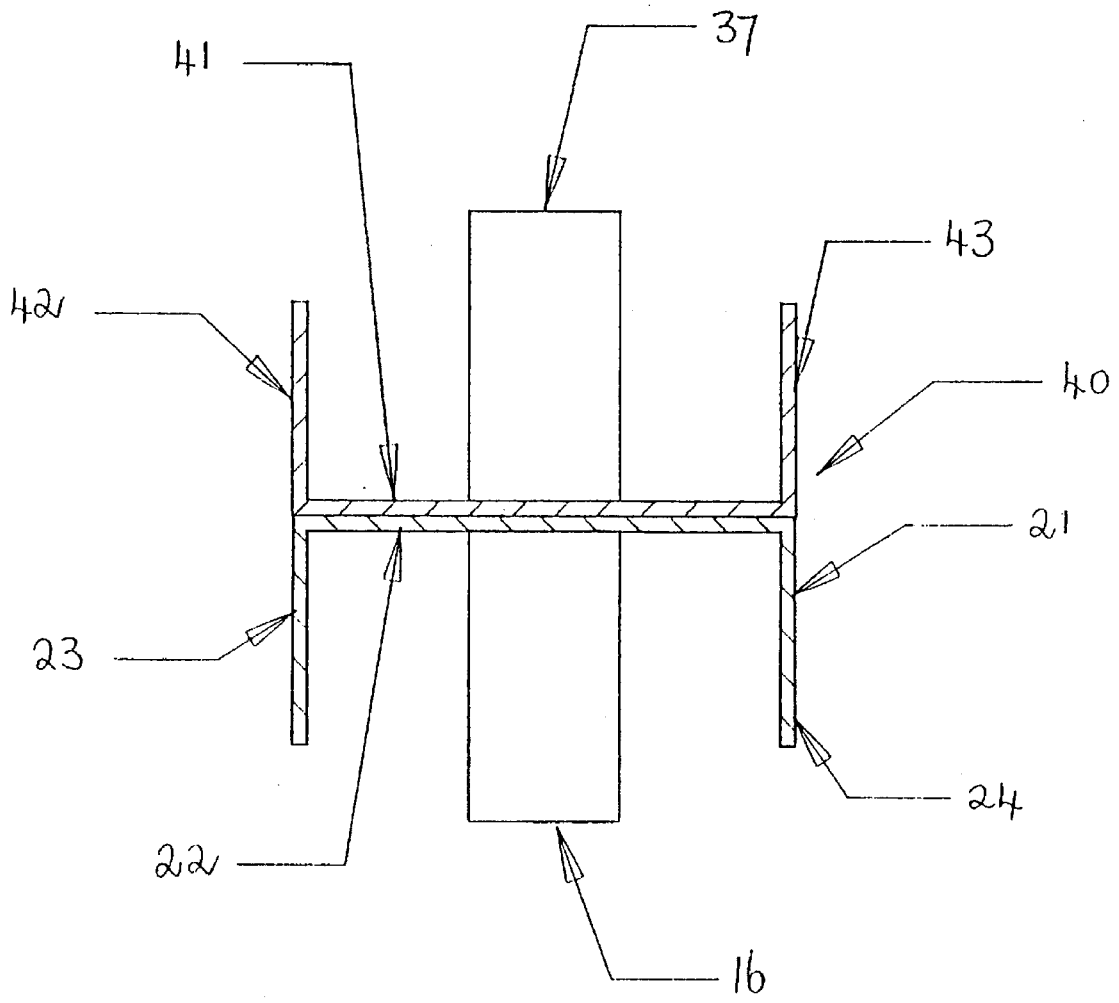
FIG. 4 is a transverse sectional view of part of the transducer of FIG. 3.

FIG. 4 shows a transverse sectional view through the shields 21 and 40 with only the permanent magnet pole piece 37 and the metallic magnetically permeable pole piece 16 shown. These shields may be made as a unitary H shaped shield.

Figure 5:
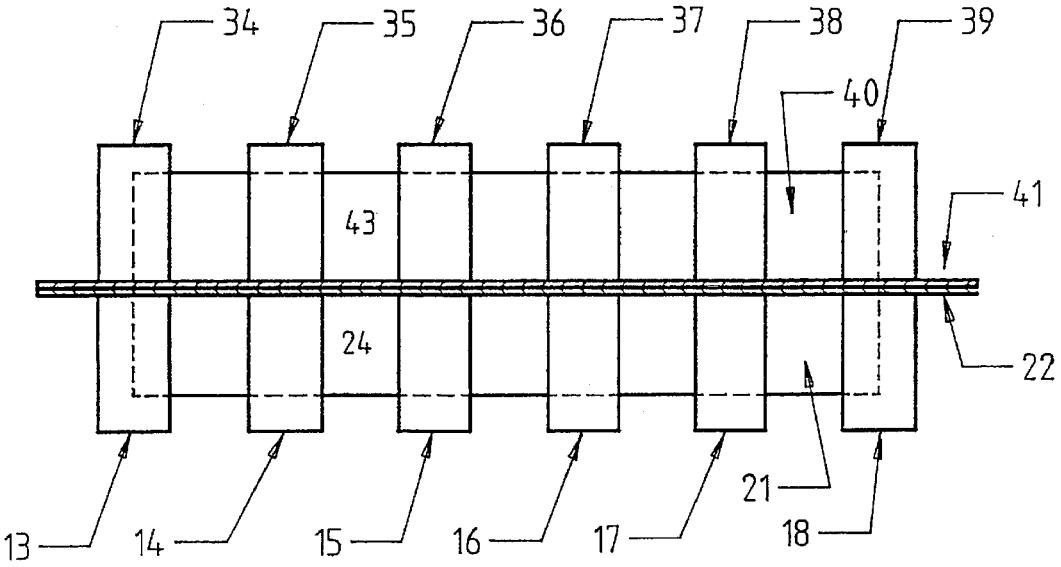
FIG. 5 is a sectional elevational view of that part of the transducer shown in FIG. 4.

FIG. 5 is a front elevational view of that part of the transducer shown in FIG. 4. The shield 40 has a web 41 and upwardly extending flanges 42, 43 which terminate halfway over outermost permanent magnet pole pieces 34, 39. Shield 21 has a web 22 and flanges 23, 24 which extend downwardly over the metallic magnetically permeable pole pieces 14, 15, 16, 17 and halfway over pieces 13 and 18.

Figure 6:
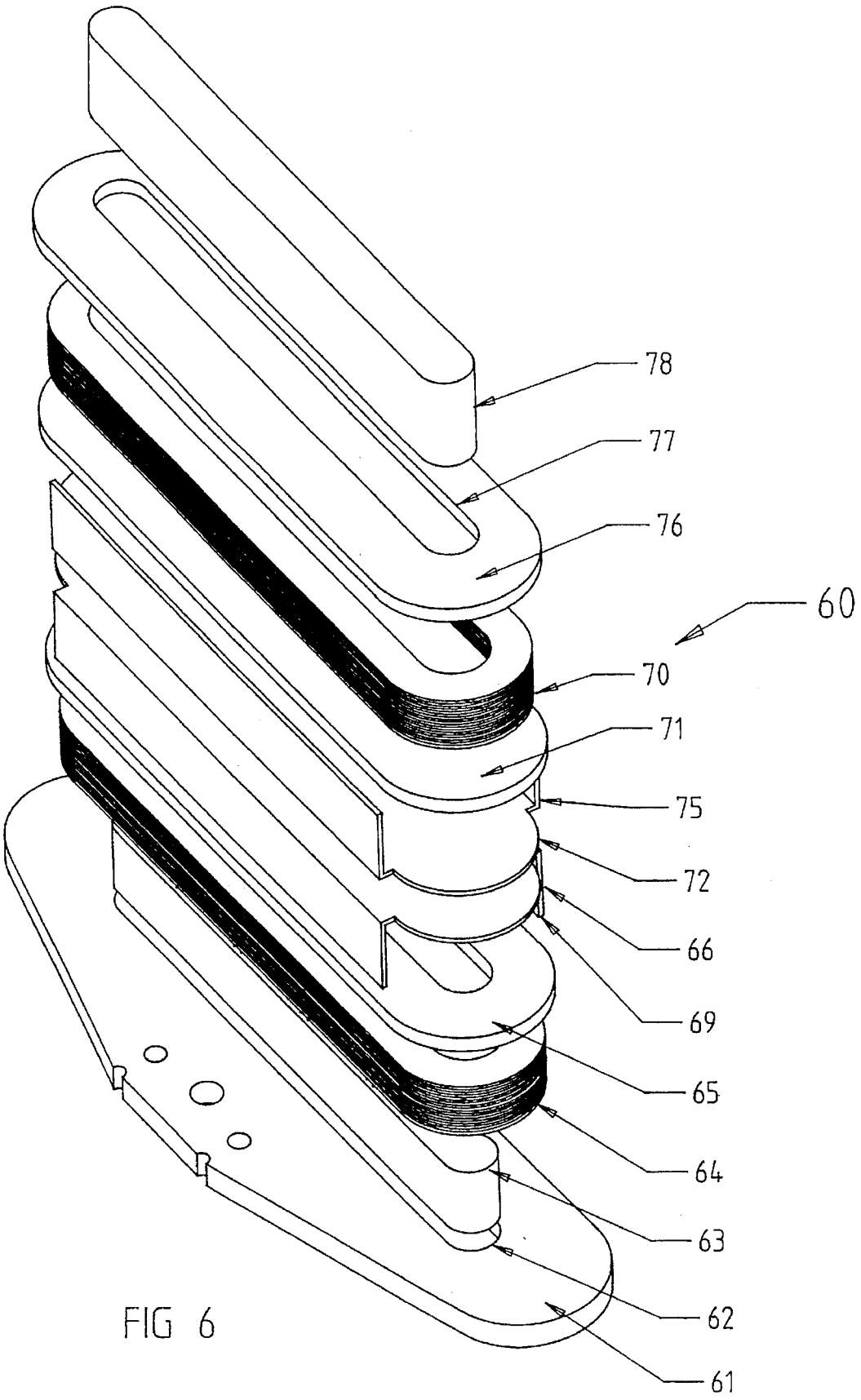
FIG. 6 is an exploded perspective view of a transducer according to another embodiment of the invention.

FIG. 6 shows an exploded perspective view of another transducer according to an embodiment of the invention. The transducer 60 has a base plate 61 constructed of a non-metallic material. Plate 61 has a slot 62 which receives a single mild steel core piece 63. A lower coil 64 locates about piece 63 and a plate 65 is positioned over the coil 64. A shield 66 extends over the coil 64 and has a base 67 with two opposed walls 68, 69. Walls 68, 69 extend over sides of the coil 64.

An upper coil 70 is present and rests upon lower plate 71. The coil 70 is received within shield 72. Shield 72 has a base 73 and opposed walls 74, 75 which extend over sides of the coil 70. A plate 76 extends over coil 70 and has a slot 77 for receiving permanent magnet pole piece 78.

In this embodiment, coil 70 has a single magnetic pole piece and a single metallic magnetically permeable pole piece is arranged within coil 64.

Figure 7:
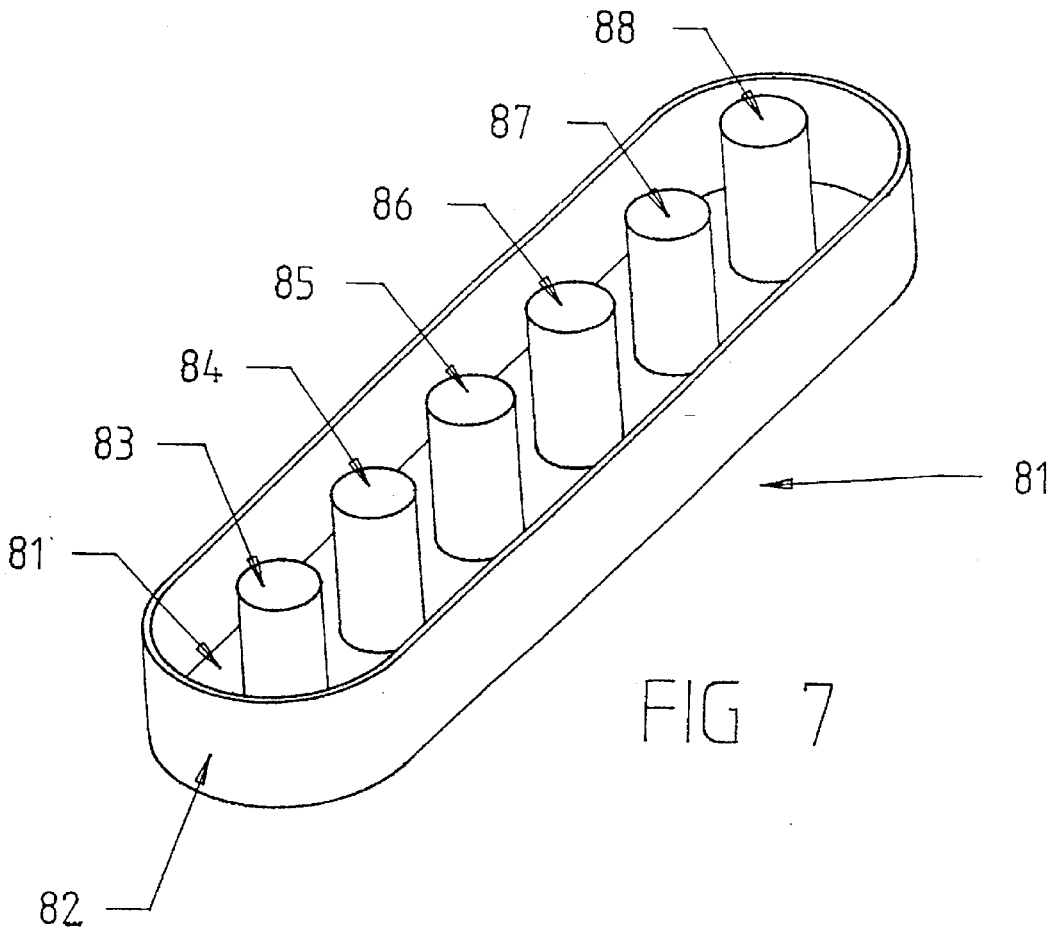
FIG. 7 is a perspective view of an alternative shield for the pick up of the invention.

FIG. 7 shows an alternative shield construction. Shield 80 is tray shaped and has a base 81 and a continuous upstanding wall 82. Pole pieces 83, 84, 85, 86, 87, 88 are shown and may either be permanent magnets or may be metallic magnetically permeable depending upon whether shield 80 is used for an upper or lower coil.

It is not necessary for the shields in a transducer to be both as shown in FIG. 7 or both of the type shown in FIG. 6. One of each may be used. Likewise, a plurality of pole pieces may be present within one of the coils and a single pole piece may be present in the other of the coils.

It is preferred that the inductance and impedance of the two coils be matched by proper choice of number of turns, wire gauge and size of the pole piece or pieces within the coils.

What is claimed is:

1. A transducer having a first coil, a second coil arranged with its axis coincident with the axis of the first coil and in use spaced below the first coil, a metallic shield made of magnetically permeable material arranged between the coils, the shield having one or more outwardly directed walls with the wall or walls of the shield extending over sides of the coils, at least one permanent magnet pole piece associated with the first coil and at least one metallic magnetically permeable pole piece associated with the second coil, whereby the coils are inductively and magnetically decoupled from one another by the shield.

2. The transducer of claim 1 wherein the permanent magnet pole piece is arranged within the upper coil.

3. The transducer of claim 2 wherein the metallic pole piece is arranged within the lower coil.

4. The transducer of claim 2 wherein each said coil is received between two spaced non-metallic plates.

5. The transducer of claim 4 wherein the plates have apertures for receiving the at least one pole piece.

6. The transducer of claim 5 wherein the at least one permanent magnet pole piece within the first coil extend through and beyond the apertures in one of the plates.

7. The transducer of claim 1 wherein the coils have an equal number of turns.

8. The transducer of claim 1 wherein the coils are both wound from wire having the same gauge.

9. The transducer of claim 1 wherein the shield has a web with rounded ends.

10. The transducer of claim 1 wherein the shield has a web and a continuous upstanding wall.

11. The transducer of claim 1 wherein the coils each have between 1000 to 7000 turns.

12. The transducer of claim 11 wherein the coils each have about 5000 turns.

13. The transducer of claim 1 having a plurality of permanent magnet pole pieces arranged within the upper coil.

14. The transducer of claim 13 wherein the permanent magnet pole pieces are cylindrical in shape and are made from either ALNICO II or V.

15. The transducer of claim 13 having a plurality of metallic pole pieces arranged within the lower coil.

16. The transducer of claim 15 wherein the metallic magnetically permeable pole pieces are cylindrical in shape and are made from mild steel.

17. The transducer of claim 15 wherein the shield is provided by two separate U shaped shield members having opposed said walls.

18. The transducer of claim 17 wherein the walls of the shields have a length extending between midpoints on outermost said pole pieces.

* * * * *